United States Patent [19]

Herzig et al.

[11] 4,370,769

[45] Feb. 1, 1983

[54] CUSHION UTILIZING AIR AND LIQUID

[76] Inventors: Ralph B. Herzig, 700 N. Rexford Dr., Beverly Hills, Calif. 90210; Howard G. Cohen, 10420 Eastborne Ave., West Los Angeles, Calif. 90024

[21] Appl. No.: 188,688

[22] Filed: Sep. 19, 1980

[51] Int. Cl.[3] ..... A47C 27/10

[52] U.S. Cl. ..... 5/452; 5/441; 5/451; 5/455; 297/459; 297/DIG. 3

[58] Field of Search ..... 5/451, 452, 455, 449, 5/450, 441; 297/DIG. 3, 458, 459

[56] References Cited

U.S. PATENT DOCUMENTS

| | | | |
|---|---|---|---|
| 1,468,072 | 9/1923 | Ogle | 5/449 |
| 3,112,956 | 12/1963 | Schick et al. | 5/455 |
| 3,308,491 | 3/1967 | Spence | 5/450 |
| 3,585,661 | 6/1971 | Gottfried et al. | 5/451 |
| 3,611,455 | 10/1971 | Gottfried | 5/451 |
| 3,810,265 | 5/1974 | McGraw | 5/451 |
| 4,101,995 | 7/1978 | Phillips | 5/452 |

FOREIGN PATENT DOCUMENTS

| | | | |
|---|---|---|---|
| 191459 | 1/1923 | United Kingdom | 5/455 |

*Primary Examiner*—Alexander Grosz
*Attorney, Agent, or Firm*—Herzig & Walsh Inc.

[57] ABSTRACT

A cushion having beneficial purposes for both persons having physical disabilities and persons who do not. It is an expandable cushion having a lower chamber for air and an upper chamber for liquid, preferably ordinary water. The water chamber or container is configurated to be over the air container and to have portions at the sides and back of the cushion, which are filled with and forced up by pressure when a person is seated on the cushion to provide a containment for the upper thighs, buttocks and lumbar region for beneficial purposes, as identified herein.

10 Claims, 14 Drawing Figures

CUSHION UTILIZING AIR AND LIQUID

BACKGROUND OF THE INVENTION

1. Field of the Invention

The field of the invention is that of resilient seats or cushions adaptable for use with any article, particularly one that a person would sit on, such as a chair.

2. Description of the Prior Art

Known prior art patents include U.S. Pat. Nos. 3,585,661; 3,900,910; 4,115,885 and 4,161,794. The known prior art does not provide an article having the particular capabilities of the herein invention, as clearly identified in the hereinafter detailed specification.

SUMMARY OF THE INVENTION

In a preferred form of the invention, it is formed of three layers of plies of a flexible impervious material such as a form of plastic or vinyl. The layers or plies are bonded together around edges to form two chambers or containers including a lower one for air with an air valve and an upper one for a liquid, such as water with a water valve.

All three plies of material are bonded together by heat sealing along a front central area for purposes that will become clear hereinafter.

The upper ply or layer forms a container for liquid between itself and the intermediate ply or layer. The cushion's upper ply may be formed with or without: (a) portions that contain pleats, (b) or vacuum formed sections allowing them to expand upwardly by liquid pressure exerted when a person sits on the cushion, the pressure being exerted partly by the air in the air container and water flowing upwardly into these portions provides a containment for the upper thighs, buttocks and lumber region of the user. The plies or layers are shaped to form a cushion of generally conventional shape, the air chamber being of general horseshoe shape having parts at the sides and rear of the cushion.

In the light of the foregoing, a primary object of the invention is to make available an improved and simplified seat or cushion having the capability when sat upon or leaned against of providing stability and containing pressure or force to preferred areas of the user, particularly the upper thighs, buttocks and lumbar region.

A further object is to make available a cushion as in the foregoing, of sheets or plies of flexible material bonded together to form a lower air chamber and an upper liquid chamber, preferably constructed to have its side and rear portions expand in response to pressure exerted by one using the cushion to provide the capabilities identified in the foregoing object.

A further object is to realize a cushion as in the foregoing wherein the top ply or layer of the cushion is constructed to include pleats or raised areas at the sides and back which form chambers that can expand upwardly in response to liquid flowing into them in order to provide the capabilities identified in the foregoing objects.

Further objects and additional advantages of the invention will become apparent from the following detailed description and annexed drawings.

DESCRIPTION OF A PREFERRED EMBODIMENT AND BEST MODE OF PRACTICE

Referring now particularly to FIGS. 1–3 and 8 of the drawings, numeral 10 designates a preferred form of the invention. In this form, it is constructed of three layers or plies of flexible impervious material, which may be plastic or vinyl, the three plies being designated at 12, 14 and 16 in the exploded view of FIG. 8.

The three plies in the constructed article are bonded together around the edges or heat sealed, as may be seen in FIGS. 4–7, the bonded areas being designated at 20.

Figure 8:
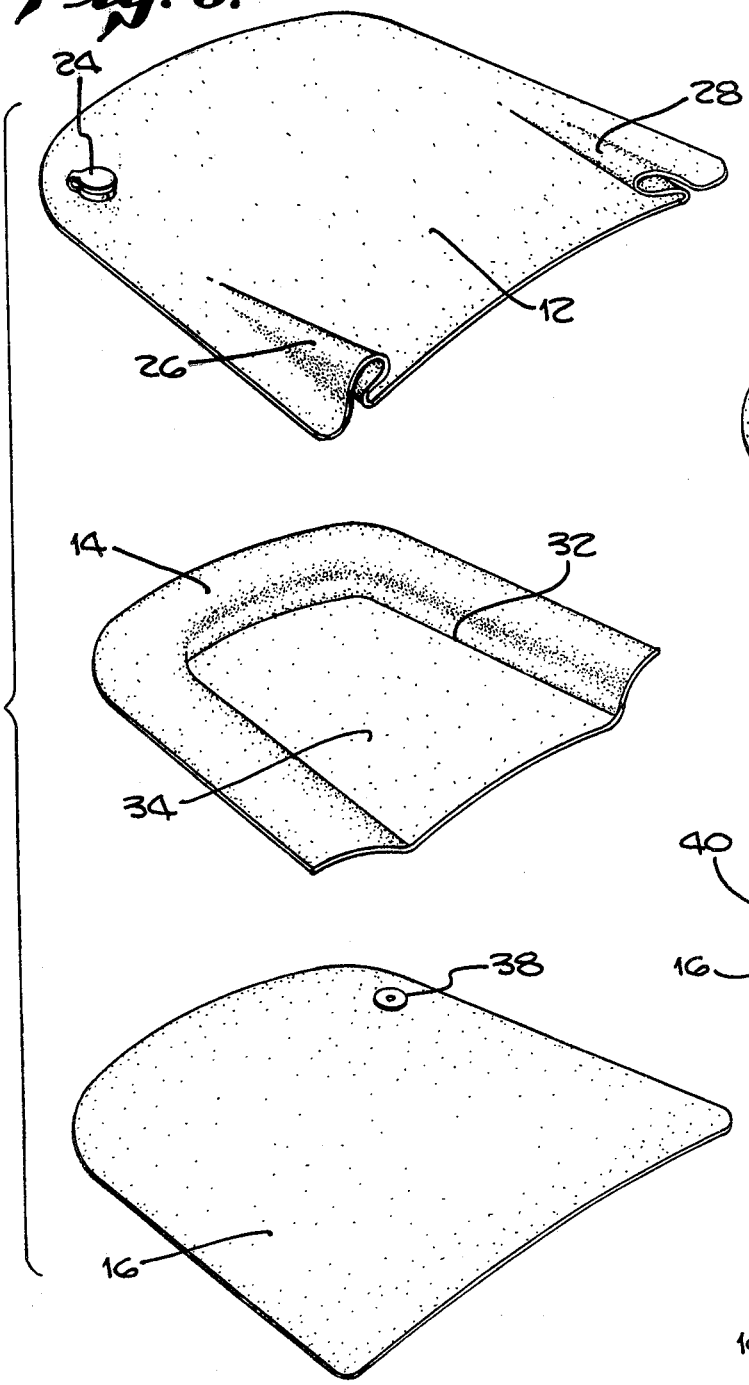
FIG. 8 is an isometric exploded view showing individually the top layer or ply of the cushion, the intermediate ply; and the bottom ply.

Referring to the top panel 12, it has a shape as shown in the figures, having a water inlet fitting, as designated at 24. It has the shape, as shown in FIG. 8. At the front side, there are provided two pleats, as designated at 26 and 28 that have this conformation when a person is not seated on the cushion.

Figure 7:
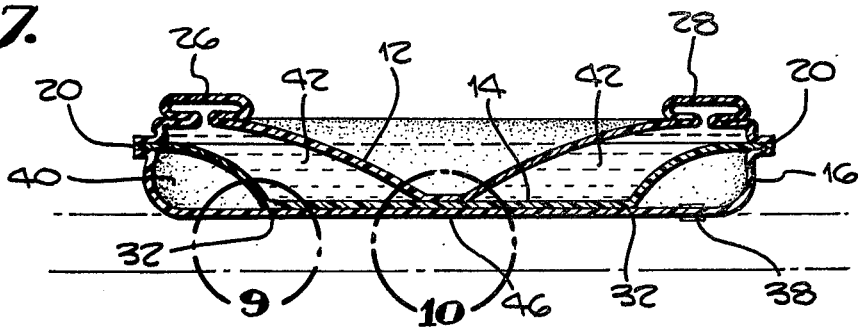
FIG. 7 is a cross-sectional view taken similarly to FIG. 6 but without a person sitting on the cushion.

Numeral 14 designates the intermediate panel, as shown in FIG. 8, the line 32 designates a boundary of an area 34 of this panel that is heat sealed to the bottom panel 16, this boundary 32 being identified in FIG. 7.

The bottom panel 16 has a shape as shown in FIG. 8, the material being shown flat in this figure. As stated, the area 34 of the intermediate panel is bonded to the bottom layer 16, as may be seen in FIGS. 4–7, the edges of the panels being bonded together, as already described and as shown in the Figures. The bottom panel 16 has a fitting 38 for admitting air into the air chamber.

From the foregoing, as can be seen, and as illustrated in the Figures, the assembly of the panels provides for an air chamber as designated at 40, which is of horseshoe shape around the outside and back of the seat. Above the air chamber there is provided a chamber for liquid, which is designated by the numeral 42.

Figure 9:
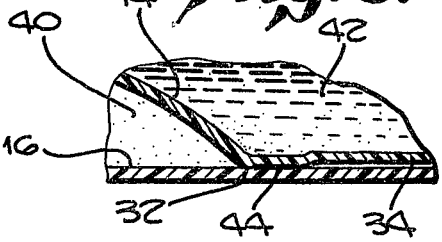
FIG. 9 is a detail sectional view of a part of FIG. 7.

The pleats 26 and 28, when no pressure is exerted on the seat, assume a configuration as shown in FIG. 7 and are then able to fill up with liquid, as will be described. The upper chamber or container, above the air chamber, is filled with liquid, preferably water. FIG. 9 illustrates the weld 44 along the line 32 between the intermediate panel 14 and the lower panel 16.

Figure 10:
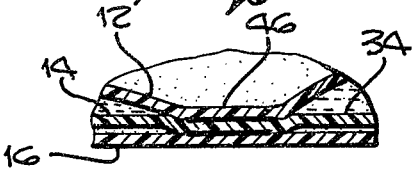
FIG. 10 is a detail sectional view of a part of FIG. 7.

At the upper center of the upper panel 12 there is a generally V shaped bond or weld 46 of heat sealing and at this area all three panels are bonded or welded together by way of heat or radio frequency sealing, this area being illustrated at 46 in FIG. 10. The purpose of this particular bonded area will be described presently.

Figure 11:
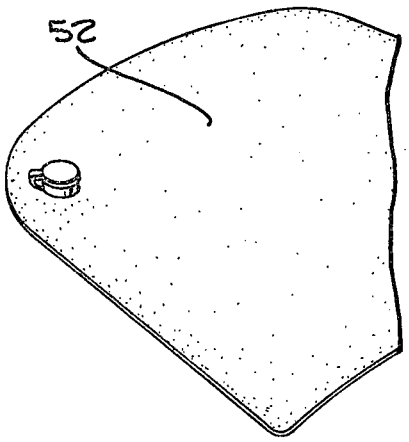
FIG. 11 is a partial view of the top ply or layer of a modified form of the invention.

In an alternative form of the invention, it may be constructed, as shown in FIG. 11, wherein the top panel 52 is formed without pleats 26 and 28 but is otherwise similar. In this form of the invention, the pressure of the air and water would simply cause upward bulging around the periphery of the upper panel around the upper thighs and buttocks of a person sitting on the cushion.

The following will describe the usage and utilization of the invention.

Figure 1:
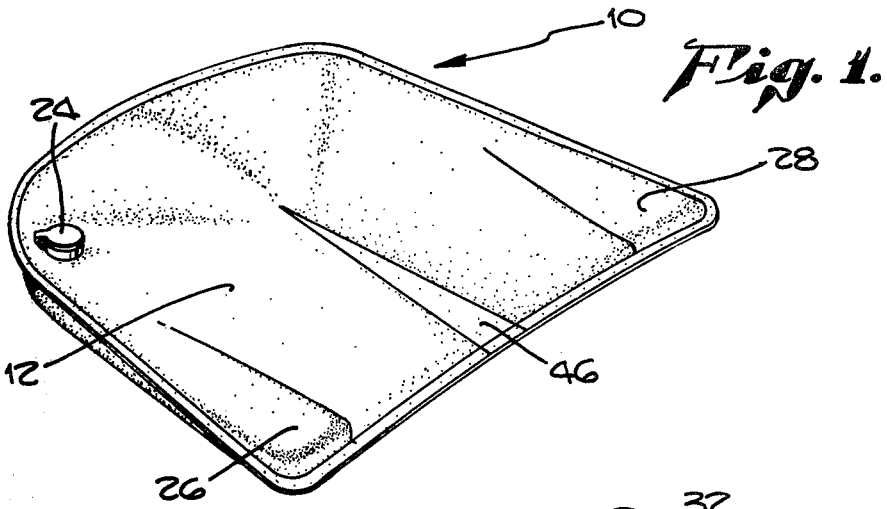
FIG. 1 is an isometric view of the top of a preferred form of the invention.
Figure 2:
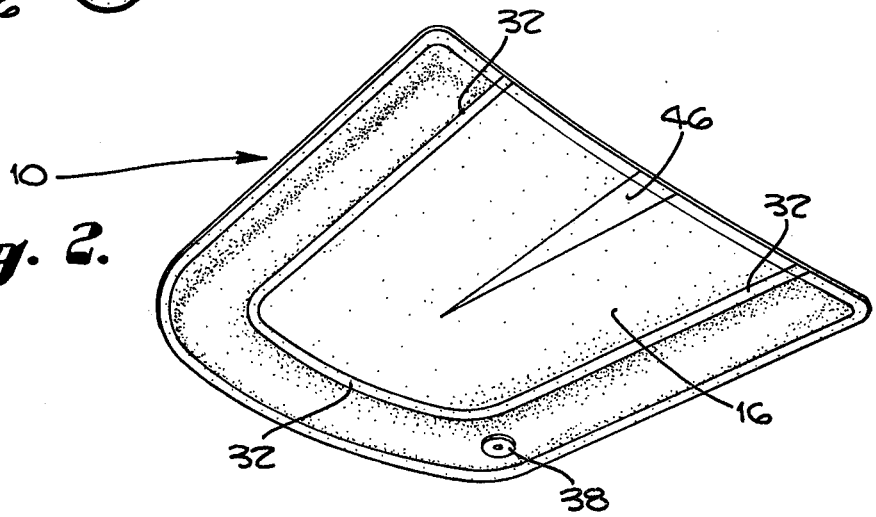
FIG. 2 is a bottom view of the form of the invention shown in FIG. 1.
Figure 3:
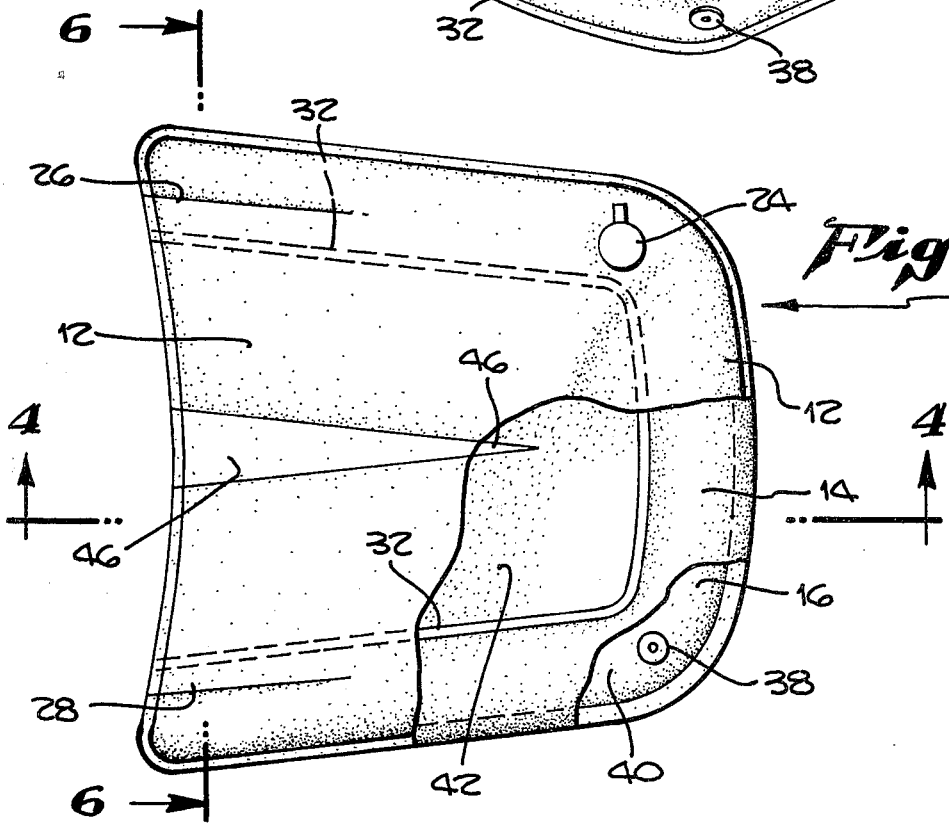
FIG. 3 is a top view of a preferred form of the invention with the top ply partly cut away.
Figure 4:
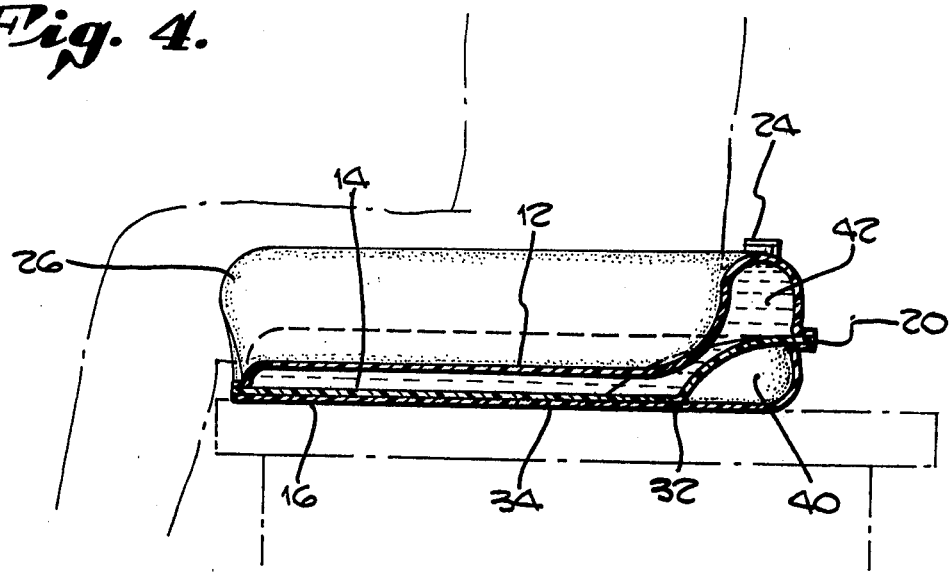
FIG. 4 is a cross-sectional view of the invention as it appears with a person sitting on the cushion.
Figure 5:
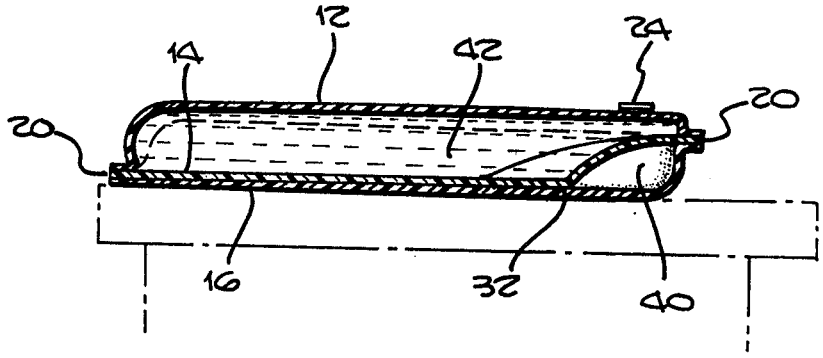
FIG. 5 is a cross-sectional view of the cushion in unoccupied condition.
Figure 6:
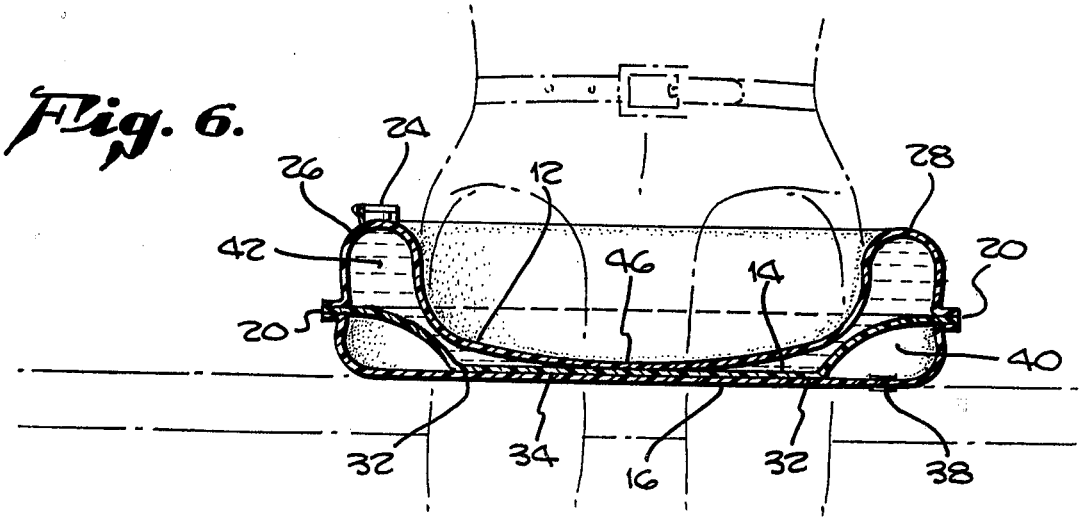
FIG. 6 is a sectional view taken along the line 6—6 of FIG. 3 with a person sitting on the cushion.

Attention should be given to the figures, FIG. 5 illustrating the configuration of the cushion when a person is not sitting on it. FIG. 4 is a cross-sectional view like FIG. 5 with a person sitting on the cushion. FIG. 7 is a cross-sectional view like FIG. 6 when a person is not sitting on the cushion and FIG. 6 illustrates the configuration when a person is sitting on the cushion.

From the foregoing, it can be observed that when a person sits on the cushion, his weight acting through the air chamber and the water chamber, above the air chamber, causes pressure to be exerted forcing the water to flow outwardly and upwardly into the volumes provided by slack portions of the layer, vacuum formed portions or the pleats 26 and 28 so that a water containing rib, so to speak, is formed around the upper thighs, buttocks and lumbar region of the person sitting on the seat. It can be readily seen how the objectives set forth in the foregoing are thus realized by the cushion. The air cushion assists in providing force bringing about the desired flow of water up into the upper part of the water containment chamber. Sealed area 46 provides an area which would eliminate direct contact between the opposite portion of the anatomy of a person sitting on the seat and this would be particularly beneficial in preventing aggravation of that area of a person's anatomy, particularly a person suffering from piles, hemorhoids or having had a hemorhoidectomy, that is, the tissues in that area would be protected from pressure or rubbing.

Figure 12:
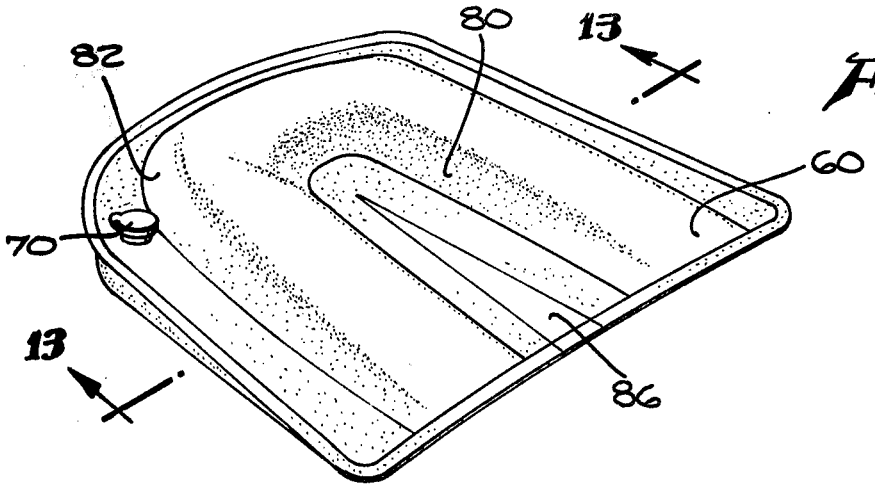
FIG. 12 is an isometric view of a modified form of the invention.
Figure 13:
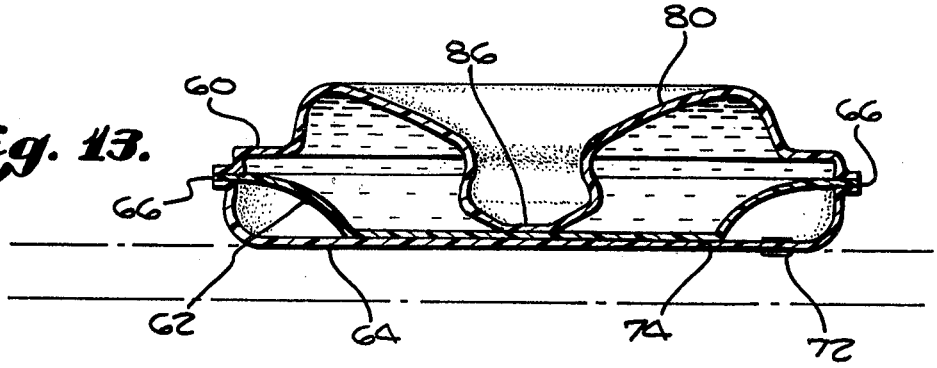
FIG. 13 is a sectional view taken along the line 13—13 of FIG. 12.
Figure 14:
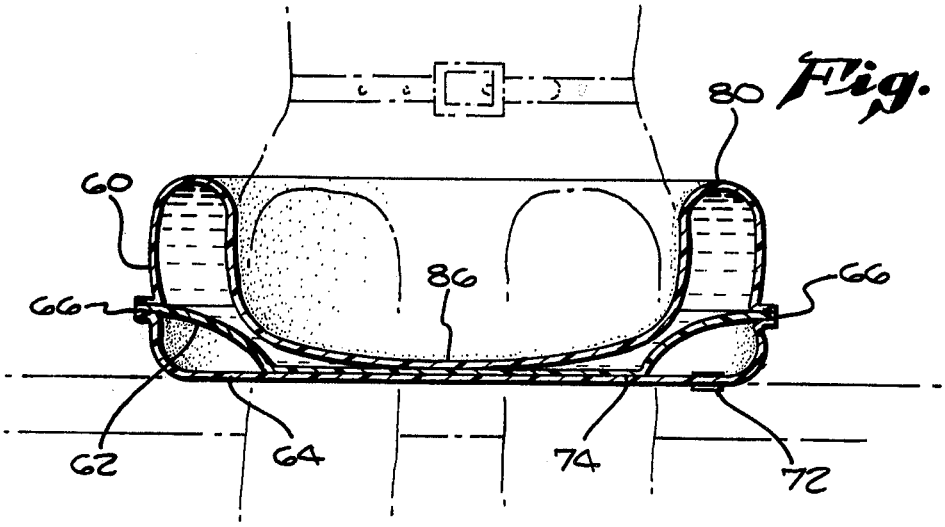
FIG. 14 is a cross-sectional view of the form of the invention of FIGS. 12 and 13 in occupied condition.

FIGS. 12, 13 and 14 show a modified form of the invention which has basic similarity to the previous embodiment of the invention but is different, particularly in respect of the fabrication of the top panel of the cushion. In this form of the invention there are three panels, 60, 62 and 64, the three plies are assembled and their edges are bonded together as shown at 66 as in the previous embodiment. The top panel 60 has a fitting as shown at 70 for water and a valve 72 as provided in the lower panel for admitting air.

The intermediate panel 62 is similar in shape to the intermediate panel of the previous embodiment. It is between the top and bottom panels. It has an intermediate portion as shown at 74, which is heat sealed or bonded to the bottom panel over an area as illustrated in the figures. The air chamber formed between panels 62 and 64 is similar to that of the previous embodiment.

In the herein embodiment a preferred form of fabrication of the panels is by vacuum forming, particularly as to the top panel which has a configuration as illustrated in the figures, FIG. 13 illustrating an unoccupied position of the cushion and FIG. 14 illustrating an occupied position. The top panel 60 has a generally U-shaped enlargement or distendable portion or bulge 80 which might be said to be of horesehoe shape which rises above the otherwise flat topped surface of the panel 62. Preferably this formation is deeper at the rear as shown at 82 with its legs tapering in depth towards the front of the cushion, as may be seen in FIG. 12. The cross sectional view 13 shows the configuration assumed by the structure 80 when the seat is not occupied. Between the legs of the U-shaped section there is an area as designated at 86 which is bonded or heat sealed to the intermediate layer 62 as may be seen in FIG. 13.

The manner of accomplishment of the objectives and the utilization of this form of the invention is similar to that of the previous embodiment. The utility is best illustrated in the FIGS. 13 and 14. When a person sits on the cushion, as illustrated in FIG. 14, the enlarged or bulged U-shaped portion 80 causes the water to be distributed and to rise at the sides into a conformation or configuration as shown in FIG. 14. The water being more dense than the air provides the desired support for the thighs and low back of the user whereby the objectives of the invention are realized.

The particular configuration of the water chamber as described assists in providing the firmness and support for the lower back and thighs as desired. As pointed out, the top ply 60 can readily be formed by vacuum forming. It should be understood also that in the previous embodiment the pleats, as previously described, can be made to extend all the way around the top ply to form more or less a U-shape if desired.

From the foregoing, those skilled in the art will readily understand the nature and construction of the invention, its utilization and the manner in which it achieves all of the objectives and advantages as set forth in the foregoing. The foregoing is a representation of preferred forms of the invention and is to be interpreted in an illustrative rather than a limiting sense, the invention to be accorded the full scope of the claims appended hereto.

What is claimed is:

1. As an article of manufacture, a cushion comprising in combination, impervious flexible material shaped to form a cushion and comprising plies bonded together at the edges along sides and back of the cushion whereby to form a lower air chamber and at positions spaced from the sides and back of the cushion and to form an upper liquid chamber, having slack portions at the sides and back of the cushion, whereby the pressure exerted by the weight of a person and the air pressure forces water in the water chamber into portions of the water chamber around the sides and back of a person seated on the cushion.

2. An article as claim 1, wherein the article includes three plies of the said impervious material bonded together in a way to provide the air chamber around the sides and rear of the cushion and the water chamber over the air chamber along the sides and rear of the cushion.

3. An article as in claim 2, wherein the plies are bonded together at an intermediate position to provide the water chamber above the air chamber having portions which can be distended by a pressure of water at the sides and back of a person sitting on the cushion.

4. An article as in claim 3, wherein the top ply of material is constructed with expansible pleats to provide expandable portions at the sides of the cushion to expand upwardly by pressure of water when a person sits on the cushion forcing water outwardly and upwardly into said positions.

5. An article as in claim 4, wherein the said pleats are constructed to form auxiliary chambers which water can flow into for expanding them when pressure is applied to the cushion by a person sitting thereon.

6. An article as in claim 5 including a central area of the cushion wherein overlying areas of the top ply and the intermediate ply are bonded together whereby when a person sits on the cushion, the person's anatomy is supported primarily by parts of the cushion adjacent to the bonded area.

7. An article as in claim 3 wherein an intermediate area of the intermediate ply is bonded to the bottom ply whereby to form around this area, an air chamber at the sides and back of the cushion.

8. As an article of manufacture, a cushion comprising in combination, impervious flexible material shaped to form a cushion including material forming an air chamber having portions at the sides and the back of the cushion positioned to form a chamber portion to provide support in the lower back area between the back and seat area, which would otherwise be unsupported, said material forming a water chamber overlying the air chamber and having slack expansible portions constructed to expand upwardly by water pressure to provide lateral support for the thighs and for the back of an occupant.

9. As an article of manufacture, a cushion comprising in combination, imprevious flexible material shaped to form a cushion including material forming an air chamber, means forming a water chamber positioned over at least part of chamber, means whereby the water chamber includes side and back portions constructed to include slack portions whereby to have water in the water chamber forced into them when a person sits on the cushion causing them to be distended to form supporting means for the thighs and back of the user.

10. As an article of manufacture, a cushion comprising in combination, impervious flexible material shaped to form a cushion and comprising plies bonded together at the edges whereby to form a lower air chamber and an upper liquid chamber, both chambers having portions at the sides and back of the cushion, whereby the pressure exerted by the weight of a person and the air pressure forces water in the water chamber into portions of the water chamber around the sides and back of the person seated on the cushion, the article including three plies of the said impervious material bonded together in a way to provide an air chamber around the sides and rear of the cushion, the plies being bonded together to provide a water chamber above the air chamber having portions which can be expanded by pressure of water at the sides and rear of a person sitting on the cushion, the top ply being formed with pleats which provide auxiliary chambers which water can flow into for expanding them when pressure is applied to the cushion by a person sitting thereon.

* * * * *